United States Patent [19]

Weaver

[11] Patent Number: 4,474,560

[45] Date of Patent: Oct. 2, 1984

[54] ELECTRIC FISHING MOTOR CONTROL

[75] Inventor: Lester C. Weaver, Fayetteville, Ark.

[73] Assignee: Shakespeare Company, Columbia, S.C.

[21] Appl. No.: 415,482

[22] Filed: Sep. 7, 1982

[51] Int. Cl.[3] ..... B63H 21/26

[52] U.S. Cl. ..... 440/6; 200/4; 318/305

[58] Field of Search ..... 440/6, 7, 84, 87; 318/305, 349, 514–516; 200/61.85, 61.87, 61.88, 61.91, 61.54, 4

[56] References Cited

U.S. PATENT DOCUMENTS

| | | | |
|---|---|---|---|
| 3,593,050 | 7/1971 | Ware | 440/6 |
| 3,596,161 | 7/1971 | Swanke | 318/305 |
| 3,599,168 | 8/1971 | Long | 440/6 |
| 3,714,919 | 2/1973 | Ernst | 440/6 |

*Primary Examiner*—Sherman D. Basinger

*Attorney, Agent, or Firm*—Renner, Kenner, Greive & Bobak

[57] ABSTRACT

An integrated control mechanism for an electric fishing motor (10). The electric fishing motor (10) has a motor tube (11) with a propulsion unit (12) secured to one end and a control head (16) mounted on the other end. An articulation assembly (35) has a frame portion (36) secured to the housing (28) of the control head (16) and a bracket portion (38) attached to the motor tube (11). The assembly (56) which effects the pivotal connection between the frame and bracket portions (36, 38) also accommodates selectively positioning the control head (16) radially about the axis (58) of the motor tube (11). A tiller (60) is secured to the frame portion (36), and an on/off switch (89) is operatively connected between the frame and bracket portion (36, 38) such that vertical manipulation of the tiller (60) articulates the assembly (35) to actuate the on/off switch (89). Rotation of the tiller (60) about its own axis actuates a rotary switch assembly (125) to operate a speed control circuit (150) whereby to select the desired speed for the electric fishing motor, and movement of the tiller (60) within a horizontal plane turns the propulsion unit (12) about the axis (58) of the motor tube (11) to steer the electric fishing motor (10). A "dead-man" arrangement (96), and a "dead-man" override (101, 103) are also provided.

12 Claims, 7 Drawing Figures

ELECTRIC FISHING MOTOR CONTROL

TECHNICAL FIELD

The present invention relates to electric fishing motors. Electric fishing motors generally comprise a motor tube, that can be supported from the side, front or back of a fishing boat. A submersible, electrically operated propulsion unit is generally secured to the lower end of the motor tube, and a control head is carried on the upper end of the motor tube. Power is normally supplied from a storage battery, or the like, which may be remotely located in the boat and transmitted into the control head by appropriate supply cables. The various switches to effect on/off, speed control and sometimes directional control are also normally mounted in the control head.

The present invention is directed specifically to the mechanical and electrical arrangement of the control members and the interrelation thereof with the control head.

BACKGROUND ART

Electric fishing motors have enjoyed widespread usage by fresh water anglers. Electric fishing motors can propel a fishing boat over a selectively variable range of relatively leisurely speeds along virtually whatever course the fisherman desires in order to permit the fisherman selectively to troll or cast.

While the boat is being so propelled, a sportsman often must control the direction and speed of his boat in concurrence with the performance of various fishing tasks such as casting, retrieving and netting. Many of these fishing tasks require a fisherman to move from his seat and away from the motor control. Thus, electric fishing motor controls that facilitate simple, efficient and effortless control of the electrical power (the on/off function), direction and speed of the electric fishing motor are necessary for safe enjoyment of the sport.

Typically, electric fishing motors are designed with a support shaft, often also designated as the motor tube, rigidly connecting a submerged propulsion unit to a control head, with the support shaft removably attached to the boat by a mounting bracket which allows rotational movement of the support shaft. Generally a lever arm extends outwardly from the control head to function as a tiller—i.e., a means by which to effect directional control—for the submersed propulsion unit. In this way horizontal rotation of the tiller about the axis of the motor tube effects a corresponding rotation of the propulsion unit, thereby permitting the fisherman to steer the boat with relative ease. Often the motor speed control is incorporated in the tiller. That is, axial rotation of the tiller changes the speed of the electric motor in the propulsion unit. Some such fishing motors have even included an on/off switch which can be operated by axial rotation of the tiller. The majority of electric fishing motors, however, provide a separate on/off switch on the control head which must be operated wholly independently of the speed control.

However, none of the known prior electric fishing motor control heads have ever provided an integrated operation which permits the fisherman independently to select, or change, speed with a single control lever and at the same time accommodate actuation of the on/off switch with that same single lever as it continues uninterruptedly to function as a tiller.

DISCLOSURE OF THE INVENTION

It is therefore an object of the present invention to provide an integrated mechanism that provides for simple, efficient and convenient on/off control for electric power, speed selection and steerage of an electric fishing motor by manipulation of a single tiller control arm.

It is another object of the present invention to provide an integrated control mechanism that allows single handed, simultaneous, or selective, actuation of the on/off power switch, speed selection and steering of an electric fishing motor.

It is a further object of the present invention to provide an integrated control mechanism that incorporates a "dead-man" switch arrangement automatically to turn the electrical power off when the operator removes his hand from the tiller of the electric fishing motor.

It is a still further object of the present invention to provide an integrated control mechanism that incorporates a "dead-man" override which allows the operator to remove his hand from the tiller of the electric fishing motor without turning the power off.

It is an even further object of the present invention to provide an integrated control mechanism whereby the "dead-man" override can be easily and quickly disengaged by a simple manipulation of the tiller, or control head, of the electric fishing motor.

It is yet another object of the present invention to provide an integrated control mechanism that permits the operator selectively to turn the power on or off by manipulation of the same tiller on the electric fishing motor through which the speed selection is controlled but without the necessity of changing a preselected speed setting.

These and other objects of the invention, as well as the advantages thereof over existing and prior art forms, which will be apparent in view of the following specification are accomplished by means hereinafter described and claimed.

In general, an integrated control mechanism embodying the concept of the present invention is particularly adapted for use in conjunction with an electric fishing motor which has a propulsion unit secured to one end of a motor tube, and a control head attached to the other end thereof.

The control head is attached to the motor tube by virtue of an articulation assembly. The articulation assembly has a frame portion and a bracket portion. A tiller is presented from the frame portion to move in conjunction with the control head, and the bracket portion is connected to the motor tube. A pivot means interconnects the bracket portion to the frame portion and permits relative articulation therebetween in response to vertical manipulation of the tiller.

A first switch means turns the propulsion unit on and off in response to articulation of the frame means with respect to the bracket means. A second switch means selects the speed at which the propulsion unit operates in response to rotation of the tiller.

Rotation of the tiller operates a second switch means in the form of a rotary switch assembly which, in turn, operates a plurality of individual switch means. A plurality of impedance means in the form of resistors of different resistance values are connected in series, and the individual switch means short across selected impedance means to provide $2^n$ different speeds from the electrically operated propulsion unit, where "n" is the number of impedance means employed.

One preferred embodiment of an electric fishing motor incorporating an integrated control mechanism embodying the concept of the present invention is shown by way of example in the accompanying drawings without attempting to show all of the various forms and modifications in which the invention might be embodied; the invention being measured by the appended claims and not by the details of the specification.

PREFERRED EMBODIMENT FOR CARRYING OUT THE INVENTION

Figure 1:
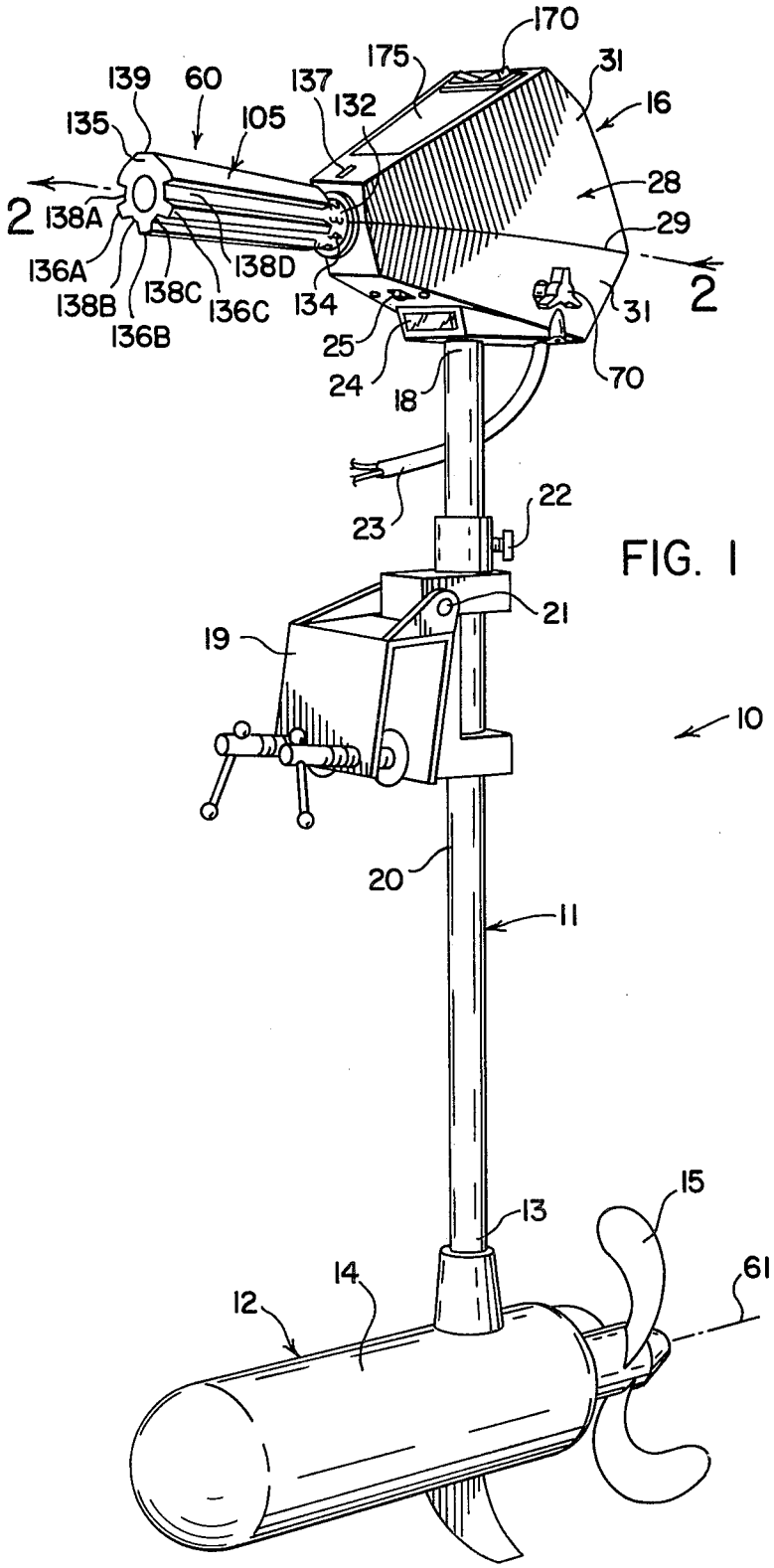
FIG. 1 is a perspective view of an electric fishing motor which employs an integrated control mechanism embodying the concept of the present invention.

An electric fishing motor which includes an integrated control mechanism that embodies the concept of the present invention is designated generally by the numeral 10 on the accompanying drawings.

Like most prior known electric fishing motors the preferred embodiment 10 disclosed herein employs a hollow support shaft, or, as it is perhaps more often designated, a motor tube 11. A submersible propulsion unit 12 is secured to the lower end portion 13 of the motor tube 11. Within the sealed outer housing 14 of the propulsion unit 12 is an electric motor (not shown except schematically in FIG. 7) which selectively rotates the propellor 15.

The hollow motor tube 11 also serves as a conduit for the wiring which connects from the electric motor within the propulsion unit 12 to the control head 16 which is secured to the upper end portion 18 of the motor tube 11.

In typical fashion a mounting bracket 19 is provided along the medial portion 20 of the motor tube 11 between the propulsion unit 12 and the control head 16. The particular mounting bracket employed is not critical to the present invention and may well be of any variety. The type depicted is perhaps most suited to be removably secured to the transom of a fishing boat but such types are also adapted to be secured to the gunwales from stem to stern.

The type of mounting bracket depicted also permits the electric fishing motor to be pivoted about horizontal pin 21 in order conveniently to remove the propulsion unit 12 from the water as is desired, if not required, when the boat is being propelled by a more powerful motor—the customary fashion by which to travel to and from the general fishing area. It is also desirable that the motor tube 11 be vertically adjustable with respect to the mounting bracket 19, as by set screw 22, but most importantly, the mounting bracket must permit the motor tube 11 to be freely rotatable. As will hereinafter become more apparent, rotation of the motor tube 11 with respect to the mounting bracket 19 is required to effect steering.

The energy required to operate the electric fishing motor 10 is generally provided by an independent power source, normally in the form of a wet cell storage battery located in the fishing boat but remotely of the electric fishing motor and connected by cable 23 which extend outwardly of the control head 16 and leads to the power source with sufficient slack so as not to restrict the required free movement of the electric fishing motor—particularly as the motor tube 11 rotates within the mounting bracket 19. In addition to providing the electrical energy necessary to operate the motor encased within the propulsion unit 12, the cable 23 may also supply energy for the operation of such added niceties as a light 24 mounted in the control head 16—and operated by the adjacent, single pole, single throw on/off switch 25—in order to afford illumination for the fisherman to tie a knot, bait a hook, remove the hook from a fish or do any of those other chores which are so easy during daylight hours but which become inordinately difficult in the dark.

The integrated control mechanism 26, which constitutes the essence of the present invention, incorporates, and is contained within, the control head 16. Thus, particular emphasis must be placed on the description of the control head 16 and the mechanism contained therein.

Figure 3:
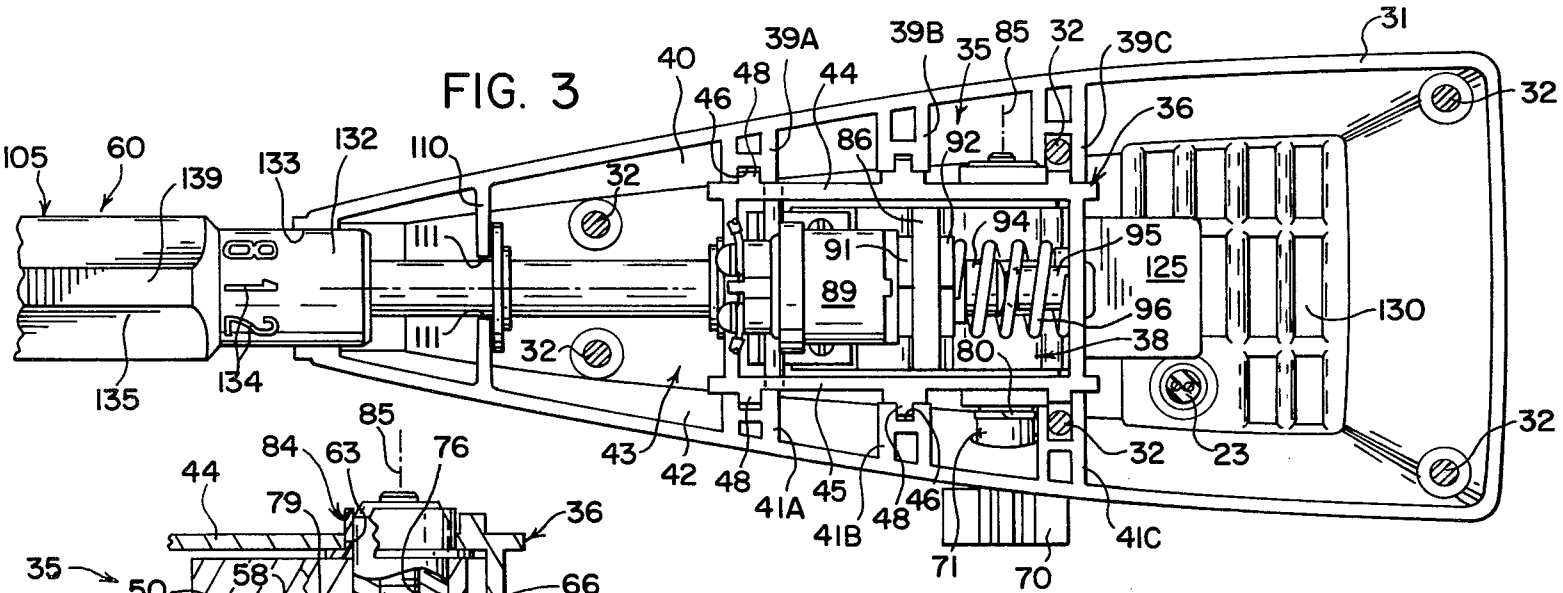
FIG. 3 is a horizontal section taken substantially along line 3—3 of FIG. 2 and depicting the mechanism which effects integrated control in top plan.

The control head 16 employs a housing 28 that is selectively separable along a horizontal parting line 29 into upper and lower segments 30 and 31, respectively. A plurality of screws 32 (FIG. 3) may be employed to secure the two segments together.

The lower housing segment 31 is attached to the upper end portion 18 of the motor tube 11 by a unique articulation assembly 35, which assembly is itself one of the principal elements employed to effect integrated operation of the control mechanism 26.

The articulation assembly 35 (FIGS. 2, 3 and 4), while it interconnects the motor tube 11 to the control head 16, nevertheless articulates to permit the control head 16 to pivot with respect to the motor tube 11. The articulation assembly 35 employs: a frame portion 36 that is rigidly secured to the housing 28 of control head 16; and, a bracket portion 38 that is attached to the motor tube 11.

If one chooses to mold the housing 28 of the control head 16 from a material such as acrylontrile-butadiene-styrene resin, more commonly known as ABS plastic, the frame portion 36 of the articulation assembly 35 may be appropriately secured within the lower housing segment 31 by employing an appropriate configuration for the strengthening ribs on the interior of the lower housing segment 31. As shown, for example, in FIG. 3, the ribs 39A, 39B and 39C may be integrally formed with one side wall 40 of the lower housing segment 31. Correspondingly opposed ribs 41A, 41B and 41C may also be integrally formed with the other side wall 42.

The opposed ribs 39 and 41 extend sufficiently into the cavity 43 defined by the lower housing segment 31 to engage the side walls 44 and 45 of the frame portion 36, the position of which within the lower housing segment 31 may be secured by providing a vertical mortise 46 within that edge of each rib 39 and 41 which lies adjacent the frame portion 36 matingly to receive corresponding tenons 48 appropriately provided along the side walls 44 and 45 of the frame portion 36. The dimensions of the ribs can thus control the precise disposition, and orientation, of the frame portion 36 within the lower housing segment 31, the importance of which will hereinafter become more apparent.

Figure 6:
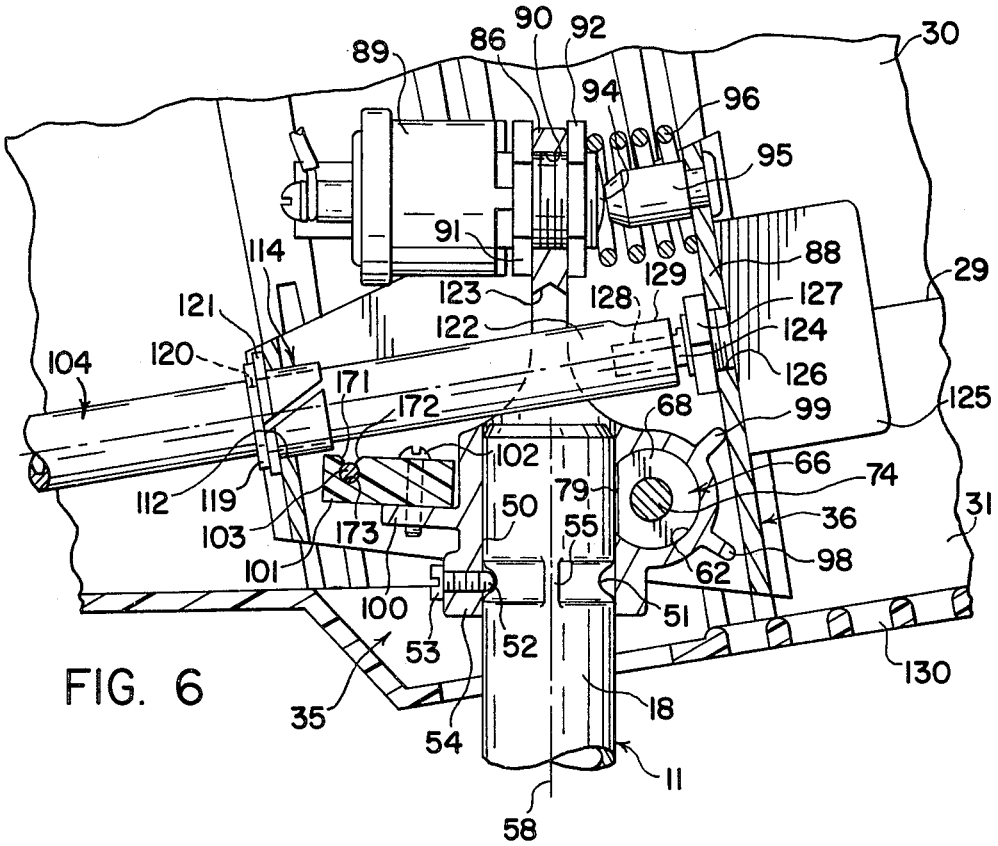
FIG. 6 is a further enlarged portion of FIG. 2 but with the tiller having been manipulated to engage the deadman override.

The second principal component of the articulation assembly 35, the bracket portion 38, presents a socket 50 in which the upper end portion 18 of the motor tube 11 is received (FIG. 6). A substantially circumferential crimp 51 recessed in the motor tube 11 receives the tip 52 of a set screw 53 threaded through the wall 54 of the socket 50 to prevent axial separation of the bracket portion 38 from the motor tube 11 after the two have been fitted together and the set screw 53 tightened. However, the set screw 53 must not be tightened sufficiently to hinder free rotation of the motor tube 11 within the socket 50 through at least a predetermined range. Inadvertent overtightening can be obviated by employing a set screw 53 of the exact length required. In that way the operator can fully tighten the set screw into the bracket portion 38 without having the tip 52 bindingly engage the crimp 51 to restrict free rotation between the motor tube 11 and the control head 16 and yet assure that the tip 52 extends sufficiently into the crimp 51 to preclude withdrawal of the motor tube 11 from the socket 50.

Figure 4:
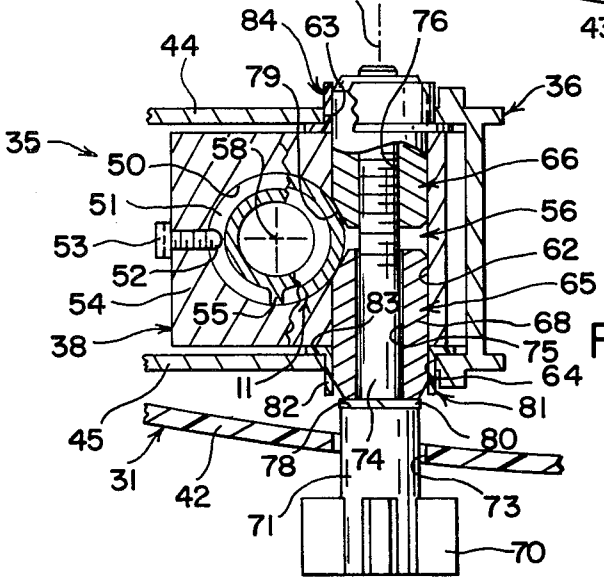
FIG. 4 is a further enlarged section taken substantially along line 4—4 of FIG. 2 and depicting the subassembly by which the control head is mounted to be selectively positionable in a horizontal plane oriented transversely with respect to the longitudinal axis of the motor tube and continuously pivotal about an axis that is oriented transversely not only to the aforesaid axis of the motor tube but also transversely the longitudinal axis of the tiller.

As is perhaps best seen in FIG. 4, the crimp 51 is discontinuous, as at 55, in order to preclude indescriminate multiple rotations of the control head 16 with respect to the motor tube 11 inasmuch as that could unduly twist the wires passing from the control head 16 to the propulsion unit 12 through the motor tube 11.

Thus, the articulation assembly 35 employs a frame portion 36 that is rigidly secured to the housing 28 of the control head 16 and a bracket portion 38 that is secured to the motor tube 11 for at least limited rotation with respect thereto. However, the frame and bracket portions 36 and 38 must articulate with respect to each other, thus allowing the control head 16 to be selectively tilted with respect to the motor tube 11. The structural arrangement 56 about which the aforesaid articulation is effected also incorporates a friction means by which selectively to orient the control head 16, as desired, in a plane transverse the longitudinal axis 58 of the motor tube 11. As will become more apparent, this permits the tiller 60 to be oriented in alignment with the thrust axis 61 of the propeller 15 irrespective of whether the mounting bracket 19 is secured to the transom, gunwale or stem of the fishing boat.

To examine the structural arrangement 56 more closely, FIG. 4 reveals a bore 62 extending through the bracket portion 38 to register with a bore 63 in side wall 44 of frame portion 36 as well as a bore 64 in side wall 45. The bore 62 is disposed transversely of, and partially intersects, the socket 50 so that the friction applying members received within the bore 62 can selectively be brought into engagement with the motor tube 11 and yet so that the means by which the friction applying members are controlled may pass axially through the bore 62 without engaging, or otherwise interfering with, the motor tube 11. With continuing reference to FIG. 4 it will be seen that the friction applying members may comprise a pair of opposed clamp elements 65 and 66 the cylindrical body portion 68 of each of which is slidably received within bore 62.

A fluted adjusting knob 70 is presented for manual manipulation exteriorly of the lower housing segment 31 and the shank portion 71 of the knob 70 extends through an access bore 73 in the side wall 42 of the lower housing segment 31. An at least partially threaded stem 74 is secured to the knob 70 and extends slidably through the axial bore 75 which penetrates clamp element 65 threadably to engage the axial bore 76 in clamp element 66.

The cylindrical body portion 68 of clamp element 65 extends outwardly through bore 64 operatively to interact with a shoulder 78 formed by the junction of the shank portion 71 and the stem 74. Thus, rotation of the knob 70 in one direction will draw the two clamp elements 65 and 66 toward each other so that the chamfered end 79 on each will frictionally engage the motor tube 11 and thereby preclude relative rotation between the bracket portion 38—and thereby the control head 16—and the motor tube 11 about the longitudinal axis 58 of the latter. Counterrotation of the knob 70 will allow the clamp elements 65 and 66 to move apart and thereby release the aforesaid frictional engagement to allow the control head 16 to be selectively positioned within a plane transverse the longitudinal axis 58 of the motor tube 11. In this way a fisherman may clamp the mounting bracket 19 as he prefers along the transom, gunwale or even to the stem of the fishing boat, counterrotate knob 70 to release the frictional interlock, orient the control head 16 to dispose the tiller 60 as he desires (normally parallel to the thrust axis 61 of propeller 15) and then rotate the knob 70 to tighten the frictional interlock. Interpositioning a lock washer 80 between the shoulder 78 and the body portion 68 of the clamp element 65 has been found satisfactorily to reduce inadvertant loosening of the friction interlock.

The body portion 68 of clamp element 65 extends outwardly of the bore 64 in side wall 45 of frame portion 36 to interact with the shoulder 78 thereby achieving operability of the frictional function of assembly 35. Additionally, that part of the body portion 68 of clamp element 65 which is received through bore 64 also serves as the pivot member about which relative articulation between the bracket portion 38 and the frame portion 36 is achieved.

An appropriate bearing surface for this articulation may be provided by employing a flanged sleeve bushing 81 of nylon, or other satisfactory, low friction material. The barrel portion 82 of the bushing 81 is interposed between the body portion 68 of clamp element 65 and the bore 64 in the side wall 45 of the frame portion 36, and the radial flange 83 is interposed between the bracket portion 38 and the side wall 45 of the frame portion 36. In this way the flange 83 not only serves to alleviate frictional resistance to selected articulation, it also serves properly to center the bracket portion 38 interiorly of the frame portion 36.

The body portion 68 of clamp element 66 is likewise axially extended to provide the pivot member through bore 63 in side wall 44, and an identical, flanged sleeve bushing 84 may be employed to provide the concomitant function of flanged sleeve bushing 81.

Thus, the structural arrangement 56 not only provides the friction means by which the bracket portion 38 may be selectively positioned circumferentially of the motor tube 11, but it also serves as the pivot means by which articulation is achieved between the frame and bracket portions 36 and 38, respectively, of the articulation assembly 35. Articulation can be specifically defined as occurring about the pivotal axis 85 (FIGS. 2 through 4) which is also the central axis of the structural arrangement 56.

Figure 2:
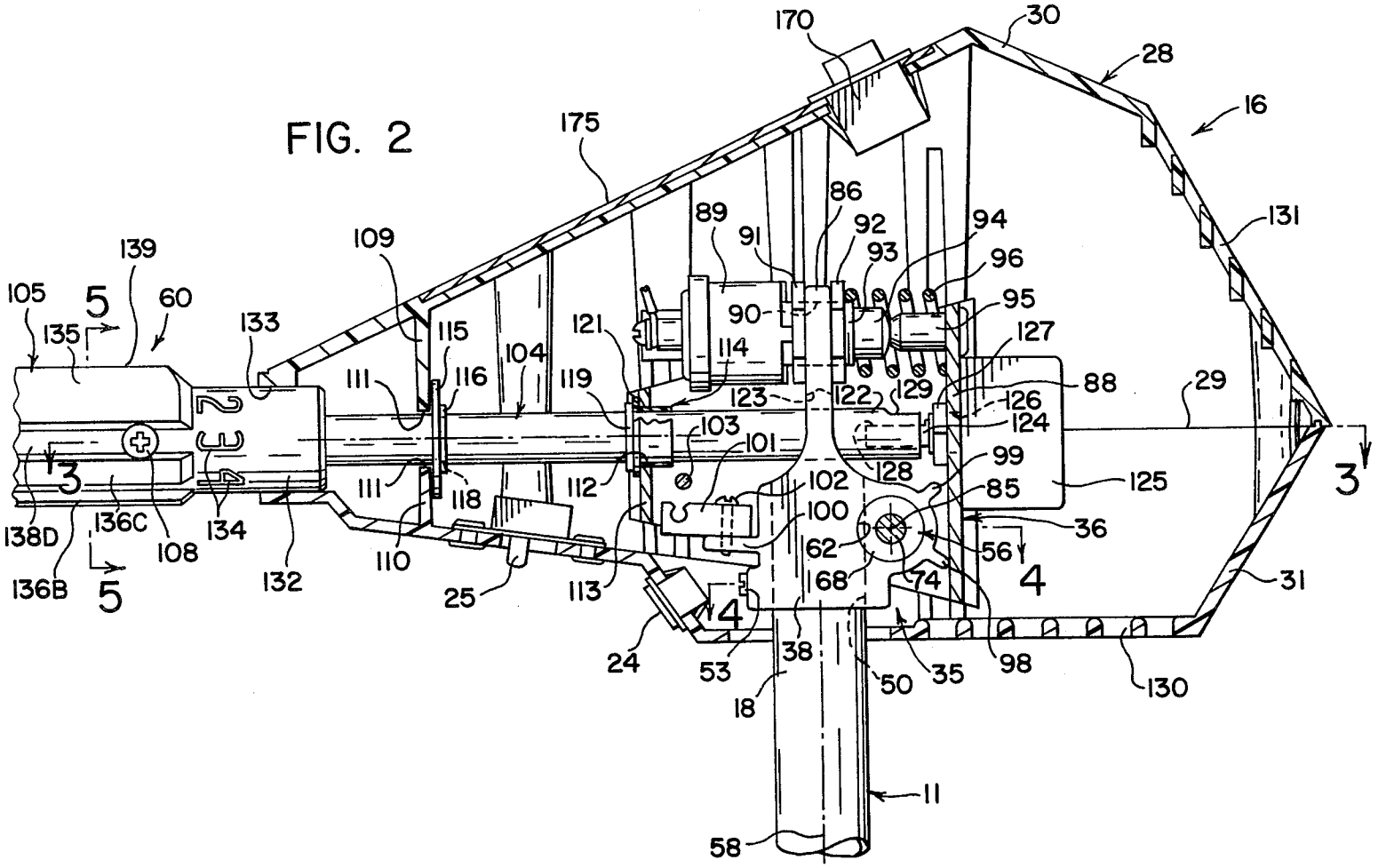
FIG. 2 is an enlarged, vertical cross section through the control head taken substantially along line 2—2 of FIG. 1 and depicting the mechanism which effects integtated control in side elevation.

Refering to FIG. 2, the side elevation of the bracket portion 38 reveals that a switch support flange 86 is provided thereon so as to be disposed in opposition to the motor tube 11 received in the socket 50. The flange 86 generally parallels the rear wall 88 of the frame portion 36, and a push button on/off switch 89 is mounted through a bore 90 in proximity to the outer extremity of the flange 86 and is secured in position by nuts 91 and 92 which are threaded onto the mounting barrel 93 of the switch 89 embracingly to engage the flange 86. As depicted, the switch 89 may be a single pole, single throw, normally open, momentary contact push button variety with the plunger button 94 facing the rear wall 88 of the frame portion 36. An appropriate actuating pin 95 is secured within the rear wall 88 so that upon articulation of the assembly 35 from the position depicted in FIG. 2 the actuating pin 95 will depress the plunger button 94 to close the circuit operated by the switch 89—that is, the switch is turned "on".

Concentrically positioned about the plunger button 94 and the actuating pin 95 is a helical, compression spring 96 that serves to bias the plunger button 94 away from the actuating pin 95.

A pair of limit flanges 98 and 99 extend rearwardly from the bracket portion 38 toward the rear wall 88 of the frame portion 36. Limit flange 98 is located on the side of the pivotal axis 85 opposite the location of switch 89. Thus, the biasing action of spring 96 will drive limit flange 98 against the rear wall 88 to determine the maximum extent to which the plunger button 94 can be withdrawn from the actuating pin 95. By selectively positioning the nuts 91 and 92 along the barrel 93 within which the plunger button 94 translates, one can predetermine the exact location at which switch 89 closes and opens—i.e., when the switch turns "on" and "off", respectively.

The second limit flange 99 is located on the same side of the pivotal axis 85 as the on/off switch 89. Thus, engagement of limit flange 99 with the rear wall 88 determines the opposite end of the rotational range through which the assembly 35 can articulate.

Finally, the bracket portion 38 incorporates a latch flange 100 which extends generally forwardly from the bracket portion 38 in a direction opposite the limit flanges 98 and 99. A clip latch 101 is secured to the flange 100 as by a plurality of screws 102, and the clip catch 101 releasably engages a pin 103 which is secured between the side walls 44 and 45 of the frame portion 36 at approximately the same time that the limit flange 99 engages the rear wall 88. As will become more apparent, the helical spring 96 contributes the "dead-man" function to the electric fishing motor 10, and the clip latch 101 and pin 103 cooperate to constitute the "dead-man" override.

Figure 5:
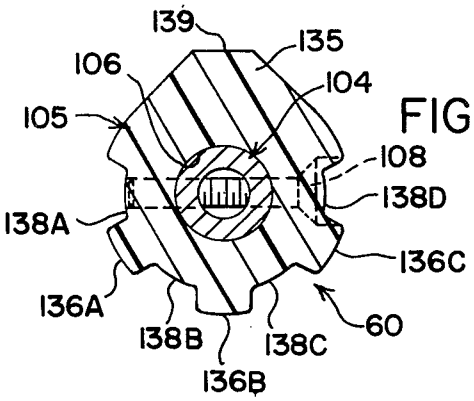
FIG. 5 is also a further enlarged cross section taken substantially along line 5—5 of FIG. 2 and depicting the tiller grip and its interconnection to the operating shaft.

The tiller 60 has an operating shaft 104 to which a grip 105 is secured. As depicted in FIG. 5, a longitudinal bore 106 extending axially into the grip 105 receives the operating shaft 104, and the two are secured together by means of a screw 108. The grip 105 is provided with setting numbers and a contoured outer surface to provide rapid identification of the speed setting, as more fully hereinafter described.

The tiller 60 is mounted in the control head 16 as follows. Opposed ribs 109 and 110 (FIG. 3) are provided in the upper and lower housing segments 30 and 31, respectively, and each terminate in a saddle 111 that embracingly engages the operating shaft 104. The operating shaft 104 also passes through a bore 112 (FIG. 2) in the forward wall 113 of the frame portion 36. A flanged sleeve bushing 114 embraces the shaft 104 and fits snugly within the bore 112 to provide a suitable bearing surface to permit facile rotation of the operating shaft 104.

A washer 115 fits over the operating shaft 104 and engages the opposed ribs 109 and 110. One may employ a ring clip 116 that is received within an annular groove 118 recessed circumferentially of the operating shaft 104 to retain the washer 115 against the ribs 109 and 110 and maintain the operating shaft 104 against retraction from the control head 16.

On the other hand such an approach requires that any such groove be accurately machined into the operating shaft 104. This manufacturing step can well be eliminated by employing a grip ring which frictionally embraces the outer surface of the operating shaft in the place of the ring clip. A similar ring clip 119, or preferably a grip ring, may engage the flange 121 on the flanged sleeve bushing 114 to maintain the bushing in the position desired and to preclude the operating shaft 104 from being forced axially inwardly beyond the desired extent.

The axially innermost end portion 122 of the operating shaft 104 passes through an aperture 123 in the switch support flange 86, which aperture 123 is of sufficient size as to preclude any interference between the operating shaft 104 and the support flange 86 during the complete operational range of both elements. The axially innermost end portion 122 of the operating shaft 104 is also coupled to the shaft 124 of a rotary switch assembly 125 which is mounted through a bore 126 in the rear wall 88 of the frame portion 36 and is secured by a mounting nut 127. The switch shaft 124 is provided with a customary flat 128 which extends axially along the switch shaft 124, and the operating shaft 104 is preferably tubular. As such, if one side of the axially inner end of the tubular operating shaft 104 is provided with a chordal flat 129 which engages the flat 128 on the switch shaft when the switch shaft 124 is received within the hollow interior of the tubular operating shaft 104 in order to provide a driving connection therebetween such that rotation of the operating shaft 104 effects corresponding rotation of the switch shaft 124.

The rotary switch assembly 125 is electrically connected to a plurality of impedance elements, such as resistors, to effect a stepped speed selection, the number of such steps in the speed selection sequence being equal to $2^n$, wherein "n" is the number of resistors. Thus, when three resistors are employed, as depicted in the exemplary arrangement of FIG. 7, the fisherman has eight speed settings available, as hereinafter more fully explained.

In part to facilitate dissipation of heat produced by any resistive elements within the control head 16, and in part to enhance the aesthetic appearance of the control head 16, a plurality of louvers 130 may be provided in the lower housing segment 31, and a plurality of louvers 131 may be similarly provided in the upper housing segment 30. Apart from their aesthetic appearance, the location of the louvers will induce the circulation of air and thereby dissipate any heat produced by the resistive elements within the head 16. For example, even if only the rotary switch assembly 125 and necessary wiring are contained within the control head 16, heat could be rapidly produced if the propellor 15 fouls, or is otherwise prevented from rotating, with the switch "on."

The tiller grip 105 which, as heretofore explained, is secured to the operating shaft 104 has a cylindrical shank portion 132 rotatably received within the annular opening 133 provided at the forward end portion of the control head housing 28. Reference numerals or other indicia, 134 are presented on the shank portion 132 to index with a lubber line 137 (FIG. 1) provided on the upper housing segment 30. In conjunction with the exemplary electric fishing motor 10 depicted there are eight such reference numerals 134. During daylight hours the reference numerals 134 permit the fisherman to tell at a glance which speed control setting has been selected, irrespective of whether or not the motor is operating.

Additionally, the grip 105, as best shown in FIGS. 1 and 5, is provided with a plurality of ribs oriented longitudinally therealong to allow tactile identification of the speed setting. In the embodiment depicted there is a large, index rib 135 and three gripping ribs 136A, 136B and 136C which are spaced about the circumference of the tiller grip 105 and separated by four recesses 138A, 138B, 138C and 138D of substantially equal circumferential span.

The three gripping ribs 136 and four recesses 138 occupy approximately 190° of the outer circumference of the grip 105, and the remaining circumference of the grip comprises the width of the large, index rib 135. The index rib 135 is not only wider than the gripping ribs 136 but also radially higher so that with relatively little practice the fisherman can tactually identify that rib as well as the particular radial orientation of the flat apex 139 thereon which readily denotes the particular speed setting.

Figure 7:
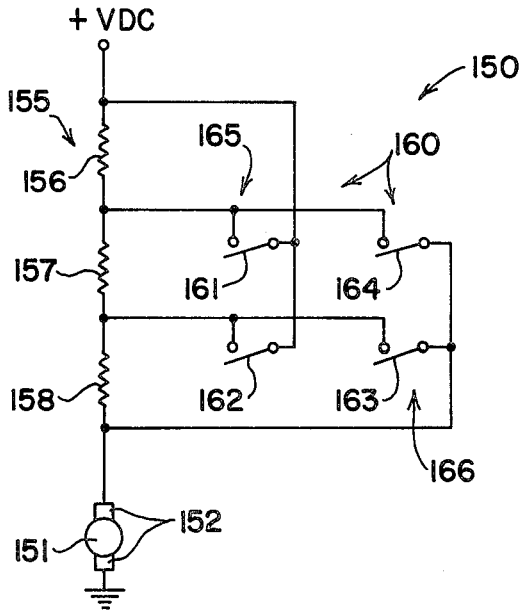
FIG. 7 is a schematic wiring diagram of the electrical circuitry which permits multiple speed settings with a minimum number of discrete resistors.

As noted hereinbefore, the present invention also contemplates a speed control circuit, generally indicated in FIG. 7 by the numeral 150, to be utilized for speed control of a conventional electric motor 151 of the type which might be encased within the propulsion unit 12 that has an armature 152 excited by a suitable direct current (D.C.) power supply. Speed control circuit 150 includes a plurality of impedance elements, denoted with the numeral 155, and a plurality of switches, denoted with the numeral 160. In the particular embodiment shown in FIG. 7, impedance elements 155 include three resistors 156, 157 and 158 electrically connected in series, the end of resistor 156 opposite that electrically connected to resistor 157 being electrically connected to one terminal (such as the positive terminal) of a suitable D.C. power supply, and the end of resistor 158 opposite that electrically connected to resistor 157 being electrically connected to one terminal of armature 152. The terminal of armature 152 opposite that electrically connected to resistor 158 is electrically connected to the remaining (in the present example, negative) terminal of the D.C. power supply.

In the embodiment shown in FIG. 7, switches 160 can be seen to include four single-pole, single-throw, maintained contact switches 161, 162, 163 and 164. Switches 160 may be thought of as being arranged in two groups, generally denoted with the numerals 165 and 166. The switches in group 165 are electrically connected in parallel with, and selectively short out, series combinations of resistors beginning with the resistor directly electrically connected to the D.C. power supply (resistor 156) and concluding with the resistor (resistor 157) adjacent the resistor directly electrically connected to one terminal of armature 152 (resistor 158). The switches in group 166 are electrically connected in parallel with, and selectively short out, series combinations of resistors beginning with the resistor directly electrically connected to one terminal armature 152 (resistor 158) and concluding with the resistor (resistor 157) adjacent the resistor directly electrically connected to the D.C. power supply (resistor 156).

Thus, in the example of FIG. 7, switches 161 and 162 form the switches of group 165, and switches 163 and 164 form the switches of group 166. Switch 161 is electrically connected in parallel with resistor 156 so that it may selectively short the same, while switch 162 is electrically connected in parallel with the series combination of resistors 156 and 157 so that it may selectively short the same. Switch 163 is electrically connected in parallel with resistor 158 so that it may selectively short the same, while switch 164 is electrically connected in parallel with the series combination of resistors 158 and 157 so that it may selectively short the same.

Speed control circuit 150 acts as a voltage divider providing up to $2^n$ different discrete voltages to armature of electric fishing motor 151, where "n" is the number of impedance elements 155 connected in series between the power supply and electric fishing motor 151, thereby resulting in up to $2^n$ different discrete speeds being furnished by electric fishing motor 151. For example, in the embodiment depicted in FIG. 7, the three resistors 156, 157 and 158 will, where provided with unequal resistance values in which the resistance of resistor 156 (for example, 0.67 ohms) is greater than that of resistor 158 (for example, 0.5 ohms) which in turn has a resistance greater than that of resistor 157 (for example, 0.33 ohms), result in $2^3$, or eight, different discrete speeds in accordance with the following switch settings:

| Speed No. | Switches Closed | Resistors Shorted |
|---|---|---|
| 1 (slowest) | None | None (all resistors in series) |
| 2 | 163 | 158 |
| 3 | 161 | 156 |
| 4 | 164 | 158 & 157 |
| 5 | 162 | 156 & 157 |
| 6 | 161 & 163 | 156 & 158 |
| 7 | 162 & 164 | None (all resistors in parallel) |
| 8 (fastest) | 161, 162, 163 & 164 | 156, 157 & 158 |

It should be appreciated that where at least two of resistors 155 have equal resistances, some of the $2^n$ possible combinations of switch settings will result in the same voltages being applied to armature 152 of electric fishing motor 151, but such resistance selection may be acceptable or even desirable for various applications.

The skilled artisan will recognize that the selection of resistance values and power ratings for resistors 155 will be fixed by the voltage and current requirements of the intended application and may be determined with well-known circuit analysis techniques. Moreover, the skilled artisan will understand that switches 161–164 inclusive may be provided in any physical configuration which would effect the desired combinations of switch settings. For example, as contemplated by the instant invention rotary switch assembly 125 may incorporate individual switches 161–164 oriented about a rotable shaft having one or more cams for achieving the desired combinations of switch settings upon the selected rotation of its shaft.

In view of the foregoing description it should now be apparent how the three resistors 156, 157 and 158 are uniquely interconnected by the rotary switch assembly 125 to provide selectively variable current flow to the armature 152 of the D.C. motor encased within the propulsion unit 12.

To this end the power enters the control head 16 by virtue of cable 23 and is directed not only to switch 25 to provide current for light 24 but also through the on/off switch 89 and from there via the speed selector, rotary switch assembly 125 to the resistor circuitry depicted in FIG. 7 for effecting the voltage to be applied to the armature 152 of the motor encased within the propulsion unit 12. However, it is generally preferred that the current be fed from the resistor circuitry through the double pole, double throw switch 170 mounted on the upper housing segment 30 before it is directed to the motor. This allows one to select the direction of the current flow through the armature 152 of the motor and thus select forward or reverse operation by the position of switch 170.

OPERATION

To one skilled in the art it should now be apparent how the integrated control mechanism employed within the aforedescribed electric fishing motor 10 accomplishes the objects of the invention. However, to obviate any possible ambiguity, the subject electric fishing motor is operated as follows.

The fisherman selects the location on the boat where the electric fishing motor 10 can be conveniently, and comfortably, operated not only for the particular day's style of fishing but also for the number of fisherman who will occupy the boat. When that location has been selected the electric fishing motor 10 will be secured to the boat by virtue of the mounting bracket 19. With the mountting bracket 19 firmly clamped to the boat, the fisherman may loosen the set screw 22 and raise or lower the motor tube 11 with respect to the bracket 19 until the propulsion unit 12 will be immersed within the water to the desired depth for the most efficient operation of the propeller 15, considering the particular water to be fished and the likelihood of hitting underwater obstructions. With the depth so chosen, the set screw 22 is retightened to secure the desired depth.

The operator will then loosen nut 70 and rotate the control head 16 about the axis 58 of the motor tube 11 until such time as the tiller 60 is positioned, or pointed, in a convenient operating direction. For most installations this will mean that the tiller 60 will generally parallel the thrust axis 61 of propeller 15 and point away from the propeller, generally as depicted in FIG. 1. In this orientation the tiller can be used to steer the boat in the manner to which most users of outboard engines are accustomed. That is, to turn in either direction the operator swings the tiller in a horizontal plane to the opposite direction.

The electric fishing motor 10 may then be swung about pin 21 to bring the propulsion unit 12 out of the water should it be necessary to propel the boat to the fishing area by means of a more powerful engine. Once at the fishing location, and with the propulsion unit resubmerged, the operator selects forward or reverse drive by appropriately positioning switch 170. Thereupon, if the cable 23 has been connected to an appropriate power source, the operator need merely apply vertically downward pressure to the tiller 60 and the resulting articulation of the assembly 35 will force the actuating pin 95 against the plunger button 94 of the on/off switch 89 to drive the propeller 15 in the preselected direction. The spring 96 has been chosen such that the weight of the operator's hand on the tiller will bring the pin 103 into contact with the opposed jaws 171 and 172 on the latch 101. In that position the motor 151 is turned on to the speed selected by virtue of the speed control circuitry 150.

Rotation of the tiller 60 will adjust the speed, up or down, as the switch assembly 125 operates the individual switches 161 through 164, but when the operator removes his hand from the tiller 60, the biasing action of spring 96 will force the plunger button 94 away from the acutating pin 95 and turn the motor off irrespective of the speed control setting. This is the so called "dead-man" arrangement. It must be appreciated that the speed setting can be selected prior to turning the motor on and off, and the selected speed can be retained, as desired, through any number of on/off cycles, or changed, as desired, with the motor either on or off. This is a unique operational feature of the present invention.

There will be those times when the fisherman may wish to have the motor remain on even when he must remove his hand from the tiller. In that situation one can employ the "dead-man" override. This function is achieved by applying additional pressure to the tiller 60 such that the pin 103 is driven past the jaws 171 and 172 into the retaining recess 173 of clip catch 101. While the jaws can be moved apart to permit entry and withdrawal of the pin 103 within the recess 173 with relatively minor additional pressure by the operator to the tiller 60, the biasing action of the spring 96 is not sufficient to withdraw the pin 103 from the recess 173 without assistance. Hence, the clip latch/pin combination effects a "dead-man" override.

The appearance of the electric fishing motor 10, and particularly the control head 16, is considered quite stylish, but the inclined face 175 which extends from the forward/reverse selector switch 170 to the tiller 60 is also quite functional. For example, if the fisherman is standing to cast into a difficult spot where he is certain a trophy fish lurks, he can rest his foot on the face of 175 to effect the desired movement. Even though too much foot pressure might well engage the "dead-man" override, that can easily be released either by raising the tiller with the foot or by applying toe pressure to the face 175 in proximity to the forward/reverse switch 170.

It should, therefore, now be readily apparent that the integrated control mechanism to which this invention is directed not only provides a relatively simply, efficient and convenient control for the on/off function, speed selection and steering of an electric fishing motor by selective manipulation of a single tiller, but also otherwise accomplishes the objects of the invention.

I claim:

1. In an electric fishing motor having a motor tube with a submersible propulsion unit secured to one end thereof and a control head mounted on the other end, an integrated control mechanism comprising;

an articulation assembly having a frame portion and a bracket portion;

a tiller presented from said frame portion to move in conjunction with said control head;

the motor tube connected to said bracket portion;

pivot means permitting said frame portion to articulate with respect to said bracket portion in response to vertical manipulation of said tiller; and, first switch means to turn the propulsion unit on and off in response to articulation of the frame portion with respect to said bracket portion.

2. An electric fishing motor, as set forth in claim 1, wherein said integrated control mechanism further comprises:

second switch means to select the speed at which said propulsion unit operates upon rotation of said tiller.

3. An electric fishing motor, as set forth in claim 2, wherein said integrated control mechanism further comprises:

a plurality of impedance means for reducing the potential applied across the armature of the motor excited by direct current;

a plurality of switch means for shorting selected impedance means whereby $2^n$ different discrete speeds are furnished by the motor, where "n" is the number of said impedance means; and, said plurality of switch means are operated by rotation of said tiller.

4. An electric fishing motor, as set forth in claim 3, wherein said integrated control mechanism further comprises:

a rotary switch assembly;

said rotary switch assembly being operated by rotation of said tiller to actuate the aforesaid plurality of switches.

5. An electric fishing motor, as set forth in claim 2, wherein said integrated control mechanism further comprises:

spring means to bias said articulation assembly toward the relative position at which said propulsion unit is turned off.

6. An electric fishing motor, as set forth in claim 5, wherein said integrated control mechanism further comprises:

a clip latch carried on said bracket portion releasably to engage a pin mounted on said frame portion in order to override said spring means.

7. An electric fishing motor, as set forth in claim 2, wherein said integrated control mechanism further comprises:

a grip presented from said tiller;

said grip presenting tactile indicia to identify the speed setting to which said tiller has been rotated.

8. An electric fishing motor, as set forth in claim 7, wherein said integrated control mechanism further comprises:

a plurality of ribs extending longitudinally along said grip to form said tactile indicia;

at least one said rib being of greater dimension than the other said ribs to constitute an index rib.

9. An electric fishing motor, as set forth in claim 1, wherein said integrated control mechanism further comprises:

a grip presented from said tiller;

said grip presenting visual indicia to identify a speed setting of said motor.

10. An electric fishing motor, as set forth in claim 1, wherein said integrated control mechanism further comprises:

means selectively to rotate and secure said control head with respect to said motor tube.

11. An electric fishing motor, as set forth in claim 10, wherein said integrated control mechanism further comprises:

a socket means in said bracket portion to receive said motor tube;

a bore extending through said bracket portion and transversely intersecting a portion of said socket means;

friction applying members slidably received within said bore; and, adjusting means selectively to engage said friction applying members with said motor tube.

12. An electric fishing motor, as set forth in claim 11, wherein said integrated control mechanism further comprises:

at least one bore in said frame portion registering with the bore through said bracket portion;

said friction applying members extending outwardly of the bore in said bracket portion and into the registered bore in said frame portion to serve as a pivot about which the desired articulation between said frame and bracket portions is effected.

* * * * *